US007902757B2

(12) United States Patent
Kawase et al.

(10) Patent No.: US 7,902,757 B2
(45) Date of Patent: Mar. 8, 2011

(54) PLASMA DISPLAY PANEL

(75) Inventors: Akira Kawase, Osaka (JP); Kazuhiro Morioka, Kyoto (JP); Kazuhiro Yokota, Hyogo (JP); Yui Saitou, Osaka (JP); Tatsuo Mifune, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/433,348

(22) Filed: Apr. 30, 2009

(65) Prior Publication Data

US 2009/0224673 A1 Sep. 10, 2009

Related U.S. Application Data

(62) Division of application No. 11/791,022, filed as application No. PCT/JP2006/319180 on Sep. 27, 2006.

(30) Foreign Application Priority Data

Oct. 3, 2005 (JP) ..... 2005-289786
Jul. 28, 2006 (JP) ..... 2006-205909

(51) Int. Cl.
*H01J 17/49* (2006.01)

(52) U.S. Cl. ..... 313/586; 313/587

(58) Field of Classification Search ..... None
See application file for complete search history.

(56) References Cited

U.S. PATENT DOCUMENTS 5,977,708 A 11/1999 Amatsu et al.
6,159,066 A 12/2000 Amatsu et al.
6,160,345 A 12/2000 Tanaka et al.
6,497,962 B1 12/2002 Fujimine et al.
6,812,641 B2 11/2004 Fujitani et al.
6,897,610 B1 5/2005 Aoki et al.
7,105,256 B2 9/2006 Fukushima
7,298,085 B2 * 11/2007 Kwon et al. ..... 313/582
7,326,666 B2 2/2008 Yamamoto et al.
7,834,551 B2 * 11/2010 Hasegawa et al. ..... 313/586

(Continued)

FOREIGN PATENT DOCUMENTS

CN 1585040 A 2/2005

(Continued)

OTHER PUBLICATIONS

European Search Report issued in Patent Application No. 06810645.9-2208 / 1816667 PCT/JP2006319180 dated on Sep. 29, 2008.

(Continued)

*Primary Examiner* — Ashok Patel
(74) *Attorney, Agent, or Firm* — McDermott Will & Emery LLP

(57) ABSTRACT

A plasma display panel (PDP) is made of front panel (2) and a rear panel. The front panel includes display electrodes (6), dielectric layer (8), and protective layer (9) that are formed on front glass substrate (3). The rear panel includes electrodes, barrier ribs, and phosphor layers that are formed on a substrate. The front panel and the rear panel are faced with each other, and the peripheries thereof are sealed to form a discharge space therebetween. Each of display electrodes (6) contains at least silver. Dielectric layer (8) is made of first dielectric layer (81) that contains bismuth oxide covering display electrodes (6), and second dielectric layer (82) that contains bismuth oxide covering first dielectric layer (81). The content of bismuth oxide in second dielectric layer (82) is smaller than the content of bismuth oxide in first dielectric layer (81).

12 Claims, 1 Drawing Sheet

U.S. PATENT DOCUMENTS

| | | | | |
|---|---|---|---|---|
| 2002/0036466 | A1 | 3/2002 | Tanaka et al. | |
| 2002/0079840 | A1 | 6/2002 | Onoda et al. | |
| 2003/0071572 | A1 | 4/2003 | Hibino et al. | |
| 2003/0108753 | A1* | 6/2003 | Fujii et al. | 428/469 |
| 2003/0137247 | A1 | 7/2003 | Kado et al. | |
| 2003/0228471 | A1 | 12/2003 | Hayakawa et al. | |
| 2004/0150337 | A1 | 8/2004 | Shiokawa et al. | |
| 2004/0232840 | A1 | 11/2004 | Aoki et al. | |
| 2004/0246204 | A1* | 12/2004 | Aoki et al. | 345/60 |
| 2004/0259452 | A1 | 12/2004 | Matsumoto et al. | |
| 2005/0242725 | A1* | 11/2005 | Hasegawa et al. | 313/582 |

FOREIGN PATENT DOCUMENTS

| | | | |
|---|---|---|---|
| JP | 05-217421 | | 8/1993 |
| JP | 9-50769 | | 2/1997 |
| JP | 9-050769 | A | 2/1997 |
| JP | 09-278483 | | 10/1997 |
| JP | 11-176336 | | 7/1999 |
| JP | 2001-48577 | | 2/2001 |
| JP | 2001-195989 | | 7/2001 |
| JP | 2001-266753 | | 9/2001 |
| JP | 2002-25341 | | 1/2002 |
| JP | 2002-53342 | | 2/2002 |
| JP | 2003-115261 | | 4/2003 |
| JP | 2003-128430 | | 5/2003 |
| JP | 2003-128430 | A | 5/2003 |
| JP | 2003-131365 | | 5/2003 |
| JP | 2003-162962 | | 6/2003 |
| JP | 2003-192376 | | 7/2003 |
| JP | 2003-128430 | | 8/2003 |
| JP | 2004-284934 | | 10/2004 |
| JP | 2004-327235 | | 11/2004 |
| JP | 2004-327456 | | 11/2004 |
| JP | 2004-345913 | | 12/2004 |
| JP | 2005-231923 | | 9/2005 |
| KR | 10-2005-0043711 | A | 5/2005 |

OTHER PUBLICATIONS

Korean Office Action issued in patent application No. KR 10-2007-7017377 dated Dec. 31, 2008.

United States Office Action issued in U.S. Appl. No. 12/555,506 dated Apr. 7, 2010.

Chinese Office Action issued in Chinese Patent Application No. CN 2006800036401 dated Mar. 27, 2009.

Chinese Office Action issued in Chinese Patent Application No. CN 2006800036435 dated Mar. 27, 2009.

United States Office Action issued in U.S. Appl. No. 11/791,022 dated Nov. 12, 2009.

United States Office Action issued in U.S. Appl. No. 11/791,022 dated Jan. 30, 2009.

United States Office Action issued in U.S. Appl. No. 11/791,022 dated Aug. 18, 2010.

* cited by examiner

PLASMA DISPLAY PANEL

RELATED APPLICATIONS

This application a divisional of U.S. application Ser. No. 11/791,022 filed on May 18, 2007, which is a U.S. National Phase under 35 U.S.C. §371 of International Application No. PCT/JP2006/319180 filed on Sep. 27, 2006, which in turn claims the benefit of Japanese Application No. 2005-289786, filed on Oct. 3, 2005 and Japanese Application No. 2006-205909, filed on Jul. 28, 2006, the disclosures of which Applications are incorporated by reference herein.

TECHNICAL FIELD

The present invention relates to a plasma display panel for use in a display device and the like.

BACKGROUND ART

A plasma display panel (herein after referred to as a PDP) can achieve higher definition and have a larger screen. Thus, a television screen using a PDP approx. 65 inch in diagonal is commercially available. Recently, with advancement of application of PDPs to high definition televisions having the number of scanning lines twice as many as conventional televisions compliant with the National Television System Committee (NTSC) system, PDPs containing no lead to address environmental issues have been required.

A PDP is basically made of a front panel and a rear panel. The front panel includes a glass substrate made of sodium borosilicate glass by the float method, display electrodes that are made of stripe-like transparent electrodes and bus electrodes formed on the principle surface of the glass substrate on one side thereof, a dielectric layer covering the display electrodes and working as a capacitor, and a protective layer that is made of magnesium oxide (MgO) formed on the dielectric layer. On the other hand, the rear panel is made of a glass substrate, stripe-like address electrodes formed on the principle surface of the glass substrate on one side thereof, a primary dielectric layer covering the address electrodes, barrier ribs formed on the primary dielectric layer, and phosphor layers formed between the respective barrier ribs and emitting light in red, green, or blue.

The front panel and rear panel are hermetically sealed with the electrode-forming sides thereof faced with each other. A Ne—Xe discharge gas is charged in the discharge space partitioned by the barrier ribs, at a pressure ranging from 400 to 600 Torr. For a PDP, selective application of image signal voltage to the display electrodes makes the electrodes discharge. Then, the ultraviolet light generated by the discharge excites the respective phosphor layers so that they emit light in red, green, or blue to display color images.

Silver electrodes are used for the bus electrodes in the display electrodes to ensure electrical conductivity thereof. Low-melting glass essentially consisting of lead oxide is used for the dielectric layer. The examples of a lead-free dielectric layer addressing recent environmental issues are disclosed in Japanese Patent Unexamined Publication Nos. 2003-128430, 2002-053342, 2001-048577, and H09-050769.

As described above, an increasing number of PDPs is applied to high definition televisions having the number of scanning lines at least twice as many as conventional NTSC-compliant televisions.

Such compliance with high definition increases the numbers of scanning lines and display electrodes, and decreases the spacing between the display electrodes. These changes increase silver ions diffused into the dielectric layer and glass substrate, from the silver electrodes constituting the display electrodes. When the silver ions diffuse into the dielectric layer and glass substrate, the silver ions are reduced by alkali metal ions in the dielectric layer, and bivalent tin ions contained in the glass substrate, thus forming silver colloids. These colloids cause a yellowing phenomenon in which the dielectric layer or glass substrate strongly colors into yellow or brown. Additionally, the silver oxide reduced generates oxygen, thus bubbles in the dielectric layer.

Thus, an increase in the number of scanning lines more conspicuously yellows the glass substrate and generates bubbles in the dielectric layer, thus considerably degrading the image quality and causing insulation failures in the dielectric layer.

However, in the examples of the conventional lead-free dielectric layer proposed to address environmental issues, the yellowing phenomenon and insulation failures of the dielectric layer cannot be inhibited at the same time.

SUMMARY OF THE INVENTION

A plasma display panel (PDP) of the present invention is made of a front panel and a rear panel. The front panel includes display electrodes, a dielectric layer, and a protective layer that are formed on a glass substrate. The rear panel includes electrodes, barrier ribs, and phosphor layers that are formed on a substrate. The front panel and the rear panel are faced with each other, and the peripheries thereof are sealed to form a discharge space therebetween. Each of the display electrodes contains at least silver. The dielectric layer is made of a first dielectric layer that contains bismuth oxide covering the display electrodes, and a second dielectric layer that contains bismuth oxide covering the first dielectric layer. The content of bismuth oxide in the second dielectric layer is smaller than the content of bismuth oxide in the first dielectric layer.

Such a structure can provide an echo-friendly PDP with high image display quality that includes a dielectric layer having a minimized yellowing phenomenon and dielectric strength deterioration and a high visible-light transmittance.

REFERENCE MARKS IN THE DRAWINGS

Figure 1:
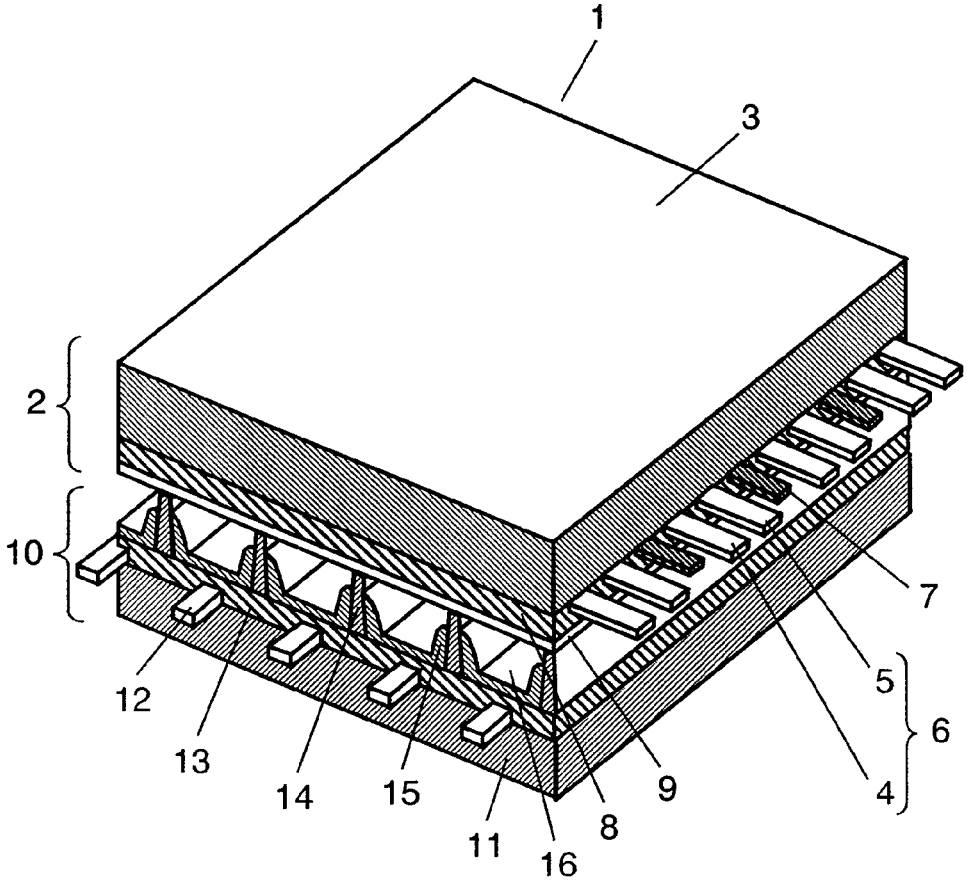
FIG. 1 is a perspective view illustrating a structure of a plasma display panel (PDP) in accordance with an exemplary embodiment of the present invention.

1 Plasma display panel (PDP)
2 Front panel
3 Front glass substrate
4 Scan electrode
4*a*, 5*a* Transparent electrode
4*b*, 5*b* Metal bus electrode
5 Sustain electrode
6 Display electrode
7 Black stripe (lightproof layer)
8 Dielectric layer
9 Protective layer
10 Rear panel
11 Rear glass substrate
12 Address electrode

13 Primary dielectric layer
14 Barrier rib
15 Phosphor layer
16 Discharge space
81 First dielectric layer
82 Second dielectric layer

DETAILED DESCRIPTION OF PREFERRED EMBODIMENT

Hereinafter, a description is provided of a plasma display panel (PDP) in accordance with the exemplary embodiment of the present invention, with reference to the accompanying drawings.

Exemplary Embodiment

FIG. 1 is a perspective view illustrating a structure of a PDP in accordance with the exemplary embodiment of the present invention. The PDP is similar to a general alternating-current surface-discharge PDP in basic structure. As shown in FIG. 1, for PDP1, front panel 2 including front glass substrate 3, and rear panel 10 including rear glass substrate 11 are faced with each other, and the outer peripheries thereof are hermetically sealed with a sealing material including glass frits. Into discharge space 16 in sealed PDP1, a discharge gas including Ne and Xe is charged at a pressure ranging from 400 to 600 Torr.

On front glass substrate 3 of front panel 2, a plurality of rows of display electrodes 6, each made of a pair of stripe-like scan electrode 4 and sustain electrode 5, and black stripes (lightproof layers) 7 are disposed in parallel with each other. Formed on front glass substrate 3 is dielectric layer 8 covering display electrodes 6 and lightproof layers 7 and working as a capacitor. Further on the surface of the dielectric layer, protective layer 9 including magnesium oxide (MgO) is formed.

On rear glass substrate 11 of rear panel 10, a plurality of stripe-like address electrodes 12 are disposed in parallel with each other in the direction orthogonal to scan electrodes 4 and sustain electrodes 5 of front panel 2. Primary dielectric layer 13 coats the address electrodes. Further on primary dielectric layer 13 between address electrodes 12, barrier ribs 14 having a predetermined height are formed to partition discharge space 16. Phosphor layers 15 are sequentially applied to the grooves between barrier ribs 14 so that ultraviolet light excites the phosphor layers to emit light in red, green, or blue for each address electrode 12. Discharge cells are formed in the positions where scan electrodes 4 and sustain electrodes 5 intersect address electrodes 12. The discharge cells that include phosphor layers 15 in red, green, or blue and are arranged in the direction of display electrodes 6 form pixels for color display.

Figure 2:
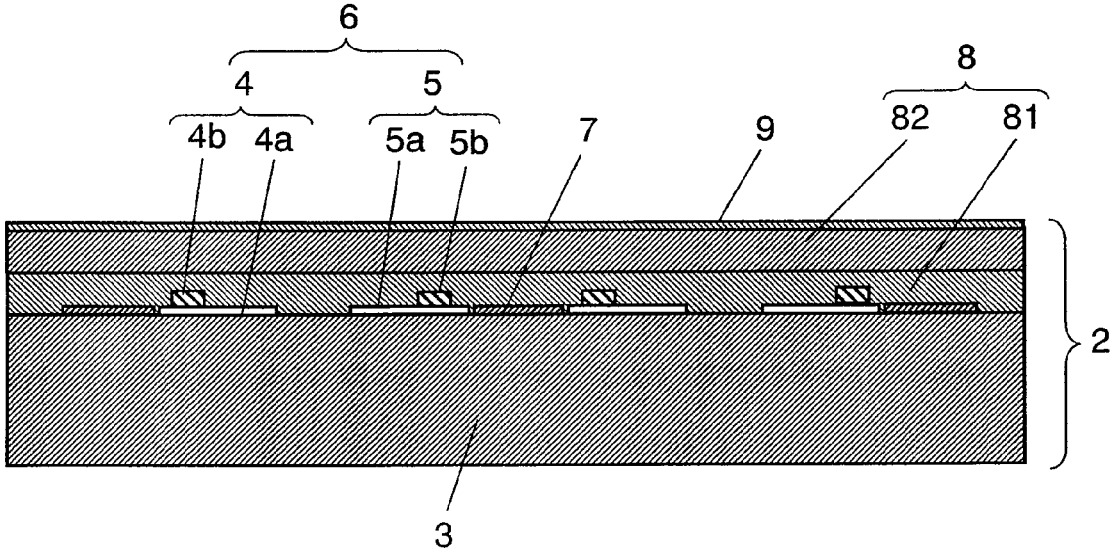
FIG. 2 is a sectional view of a front panel illustrating a structure of a dielectric layer of the PDP in accordance with the exemplary embodiment of the present invention.

FIG. 2 is a sectional view of front panel 2 illustrating a structure of dielectric layer 8 of PDP 1 in accordance with the exemplary embodiment of the present invention. FIG. 2 shows a vertically inverted view of FIG. 1. As shown in FIG. 2, display electrodes 6, each made of scan electrode 4 and sustain electrode 5, and lightproof layers 7 are patterned on front glass substrate 3 made by the float method or the like. Display electrodes 4 and sustain electrodes 5 include transparent electrodes 4*a* and 5*a* made of indium tin oxide (ITO) or tin oxide ($SnO_2$), and metal bus electrodes 4*b* and 5*b* formed on transparent electrodes 4*a* and 5*a*, respectively. Metal bus electrodes 4*b* and 5*b* are used to impart electrical conductivity to transparent electrodes 4*a* and 5*a* in the longitudinal direction thereof, and made of a conductive material essentially consisting of silver (Ag) material.

Dielectric layer 8 is structured of at least two layers: first dielectric layer 81 covering transparent electrodes 4*a* and 5*a*, metal bus electrodes 4*b* and 5*b*, and lightproof layers 7 formed on front glass substrate 3; and second dielectric layer 82 formed on first dielectric layer 81. Further, protective layer 9 is formed on second dielectric layer 82.

Next, a description is provided of a method of manufacturing a PDP. First, scan electrodes 4, sustain electrodes 5, and lightproof layers 7 are formed on front glass substrate 3. These transparent electrodes 4*a* and 5*a*, and metal bus electrodes 4*b* and 5*b* are patterned by methods including the photo lithography method. Transparent electrodes 4*a* and 5*a* are formed by the thin film process or the like. Metal bus electrodes 4*b* and 5*b* are solidified by firing a paste containing a silver (Ag) material at a desired temperature. Lightproof layers 7 are formed by the similar method. A paste containing a black pigment is silk-screened, or a black pigment is applied to the entire surface of the glass substrate and patterned by the photo lithography method, and then the paste or the pigment is fired.

Next, a dielectric paste is applied to front glass substrate 3 to cover scan electrodes 4, sustain electrodes 5, and lightproof layers 7 by the die coat method or the like, to form a dielectric paste layer (dielectric material layer). Leaving the dielectric paste for a predetermined period after application levels the surface of the applied dielectric paste and provides a flat surface. Thereafter, solidifying the dielectric paste layer by firing forms dielectric layer 8 covering scan electrodes 4, sustain electrodes 5, and lightproof layers 7. The dielectric paste is a paint containing a dielectric material, such as a glass powder, as well as a binder, and a solvent. Next, protective layer 9 made of magnesium oxide (MgO) is formed on dielectric layer 8 by vacuum deposition. With these steps, a predetermined structure (scan electrodes 4, sustain electrodes 5, lightproof layers 7, dielectric layer 8, and protective layer 9) is formed on front glass substrate 3. Thus, front panel 2 is completed.

On the other hand, rear panel 10 is formed in the following process. First, a material layer to be a structure for address electrodes 12 is formed by silk-screening a paste containing silver (Ag) material on rear glass substrate 11, or forming a metal layer on the entire rear glass substrate followed by patterning the layer by the photo lithography method. Then, the structure is fired at a desired temperature, to form address electrodes 12. Next, on rear glass substrate 11 having address electrodes 12 formed thereon, a dielectric paste is applied to cover address electrodes 12 by the die coat method or the like, to form a dielectric paste layer. Thereafter, the dielectric paste layer is fired, to form primary dielectric layer 13. The dielectric paste is a paint containing a dielectric material, such as glass powder, as well as a binder, and a solvent.

Next, after a paste for forming barrier ribs containing a barrier rib material is applied to primary dielectric layer 13 and patterned into a predetermined shape to form a barrier rib material layer, the material layer is fired to form barrier ribs 14. The usable methods of patterning the barrier rib paste applied to primary dielectric layer 13 include the photo lithography method and sandblast method. Next, a phosphor paste containing a phosphor material is applied to primary dielectric layer 13 between adjacent barrier ribs 14 and the side surfaces of barrier ribs 14 and fired, to form phosphor layers 15. With these steps, rear panel 10 having predetermined structural members on rear glass substrate 11 is completed.

Front panel 2 and rear panel 10 including predetermined structural members manufactured as above are faced with each other so that scan electrodes 4 are orthogonal to address electrodes 12. Then, the peripheries of the panels are sealed with glass frits, and a discharge gas including Ne and Xe is charged into discharge space 16. Thus, PDP 1 is completed.

A detailed description is provided of first dielectric layer 81 and second dielectric layer 82 constituting dielectric layer 8 of front panel 2. The dielectric material of first dielectric layer 81 is composed of the following components: 20 to 40 wt % of bismuth oxide ($Bi_2O_3$), 0.5 to 12 wt % of at least one selected from calcium oxide (CaO), strontium oxide (SrO), and barium oxide (BaO), and 0.1 to 7 wt % of at least one selected from molybdenum trioxide ($MoO_3$), tungstic trioxide ($WO_3$), cerium dioxide ($CeO_2$), and manganese dioxide ($MnO_2$).

In place of molybdenum trioxide ($MoO_3$), tungstic trioxide ($WO_3$), cerium dioxide ($CeO_2$), and manganese dioxide ($MnO_2$), the dielectric material may contain 0.1 to 7 wt % of at least one selected from cupper oxide (CuO), chromium oxide ($Cr_2O_3$), cobalt oxide ($Co_2O_3$), vanadium oxide ($V_2O_7$), and antimony oxide ($Sb_2O_3$).

In addition to the above components, the dielectric material may contain components other than lead, such as 0 to 40 wt % of zinc oxide (ZnO), 0 to 35 wt % of boron oxide ($B_2O_3$), 0 to 15 wt % of silicon dioxide ($SiO_2$), and 0 to 10 wt % of aluminum oxide ($Al_2O_3$). The contents of these components are not specifically limited, and are within the range of the contents in the conventional arts.

The dielectric material having such composition is pulverized with a wet jet mill or ball mill to have an average particle diameter ranging from 0.5 to 2.5 μm, to provide a dielectric material powder. Next, 55 to 70 wt % of this dielectric material powder and 30 to 45 wt % of binder components are sufficiently kneaded with a three-roll kneader, to provide a first dielectric layer paste for die coat or printing.

The binder components include ethylcellulose, terpioneol containing 1 to 20 wt % of acrylate resin, or butyl carbitol acetate. As needed, the paste may additionally contain dioctyl phthalate, dibutyl phthalate, triphenyl phosphate, or tributyl phosphate, as a plasticizer, and glycerol monooleate, sorbitan sesquioleate, or alkyl-aryl phosphate esters, as a dispersant, to improve printability.

Next, the paste for the first dielectric layer is applied to front glass substrate 3 to cover display electrodes 6 by the die coat or silk-screen printing method, and dried. Thereafter, the paste is fired at a temperature ranging from 575 to 590° C., slightly higher than the softening point of the dielectric material, to provide first dielectric layer 81.

Next, a description is provided of second dielectric layer 82. The dielectric material of second dielectric layer 82 is composed of the following components: 11 to 20 wt % of bismuth oxide ($Bi_2O_3$), 6 to 21 wt % of at least one selected from calcium oxide (CaO), strontium oxide (SrO), and barium oxide (BaO), and 0.1 to 7 wt % of at least one selected from molybdenum trioxide ($MoO_3$), tungstic trioxide ($WO_3$), and cerium dioxide ($CeO_2$).

In place of molybdenum trioxide ($MoO_3$), tungstic trioxide ($WO_3$), and cerium dioxide ($CeO_2$), the dielectric material may contain 0.1 to 7 wt % of at least one selected from cupper oxide (CuO), chromium oxide ($Cr_2O_3$), cobalt oxide ($Co_2O_3$), vanadium oxide ($V_2O_7$), antimony oxide ($Sb_2O_3$), and manganese dioxide ($MnO_2$).

In addition to the above components, the dielectric material may contain components other than lead, such as 0 to 40 wt % of zinc oxide (ZnO), 0 to 35 wt % of boron oxide ($B_2O_3$), 0 to 15 wt % of silicon dioxide ($SiO_2$), and 0 to 10 wt % of aluminum oxide ($Al_2O_3$). The contents of these components are not specifically limited, and are within the range of the contents in the conventional arts.

The dielectric material having such composition is pulverized with a wet jet mill or ball mill to have an average particle diameter ranging from 0.5 to 2.5 μm, and a dielectric material powder is provided. Next, 55 to 70 wt % of this dielectric material powder and 30 to 45 wt % of binder components are sufficiently kneaded with a three-roll kneader, to provide a second dielectric layer paste for die coat or printing. The binder components include ethylcellulose, terpioneol containing 1 to 20 wt % of acrylate resin, or butyl carbitol acetate. As needed, the paste may additionally contain dioctyl phthalate, dibutyl phthalate, triphenyl phosphate, or tributyl phosphate, as a plasticizer, and glycerol monooleate, sorbitan sesquioleate, or alkyl aryl phosphate esters, as a dispersant, to improve printability.

Next, the paste for the second dielectric layer is applied to first dielectric layer 81 by the silk-screen printing method or the die coat method, and dried. Thereafter, the paste is fired at a temperature ranging from 550 to 590° C., slightly higher than the softening point of the dielectric material, to provide second dielectric layer 82.

Preferably, the thickness of dielectric layer 8 is up to 41 μm to ensure the total visible-light transmittance of first dielectric layer 81 and second dielectric layer 82. The content of bismuth oxide ($Bi_2O_3$) in first dielectric layer 81, ranging from 20 to 40 wt %, is larger than the content of bismuth oxide ($Bi_2O_3$) in second dielectric layer 82 so that the reaction of metal bus electrodes 4*b* and 5*b* with silver (Ag) is inhibited. For this reason, the visible-light transmittance of first dielectric layer 81 is lower than the visible-light transmittance of second dielectric layer 82. Thus, the thickness of first dielectric layer 81 is made thinner than the thickness of second dielectric layer 82.

For second dielectric layer 82, with a content of bismuth oxide ($Bi_2O_3$) up to 11 wt %, coloring is unlikely to occur, but bubbles are likely to foam in second dielectric layer 82. Thus, this content is not preferable. With a content of bismuth oxide ($Bi_2O_3$) exceeding 40 wt %, coloring is likely to occur. For this reason, this content is not preferable to increase the transmittance.

The advantage of increasing the brightness of the panel and decreasing the discharge voltage is more distinct at the smaller thickness of dielectric layer 8. For this reason, preferably, the thickness is as small as possible within the range in which the dielectric voltage does not decrease. From such a viewpoint, in this exemplary embodiment of the present invention, the thickness of dielectric layer 8 is up to 41 μm, with that of first dielectric layer 81 ranging from 5 to 15 μm and that of second dielectric layer 82 ranging from 20 to 36 μm.

It is confirmed that a PDP manufactured in this manner includes front glass substrate 3 having a less coloring (yellowing) phenomenon, and dielectric layer 8 with no bubbles generated therein and an excellent dielectric strength, even with the use of a silver (Ag) material for display electrodes 6.

Next, consideration is given to the reasons why these dielectric materials inhibit yellowing or foaming in first dielectric layer 81, in a PDP in accordance with the exemplary embodiment of the present invention. It is known that addition of molybdenum trioxide ($MoO_3$) or tungstic trioxide ($WO_3$) to dielectric glass containing bismuth oxide ($Bi_2O_3$) is likely to generate compounds, such as $Ag_2MoO_4$, $Ag_2Mo_2O_7$, $Ag_2Mo_4O_{13}$, $Ag_2WO_4$, $Ag_2W_2O_7$, and $Ag_2W_4O_{13}$, at a low temperature up to 580° C. In the exemplary embodiment of the present invention, the firing temperature of dielectric layer 8 ranges from 550 to 590° C. Thus, silver ions ($Ag^+$) diffused in dielectric layer 8 during firing react with molybdenum trioxide ($MoO_3$), tungstic trioxide ($WO_3$), cerium dioxide ($CeO_2$), and manganese dioxide ($MnO_2$) in dielectric layer 8, generate stable compounds, and stabilize. In other words, because the silver ions ($Ag^+$) are not reduced and are stabilized, the ions do not coagulate into colloids. Consequently, the stabilization of the silver ions ($Ag^+$) decreases oxygen generated by colloidization of silver (Ag), thus reducing the bubbles generated in dielectric layer 8.

On the other hand, preferably, the content of molybdenum trioxide ($MoO_3$), tungstic trioxide ($WO_3$), cerium dioxide ($CeO_2$), or manganese dioxide ($MnO_2$) in the dielectric glass containing bismuth oxide ($Bi_2O_3$) is at least 0.1 wt %, to offer these advantages. More preferably, the content ranges from 0.1 to 7 wt %. Particularly with a content smaller than 0.1 wt %, the advantage of inhibiting yellowing is smaller. With a content exceeding 7 wt %, yellowing occurs in the glass, and is not preferable.

In other words, for dielectric layer 8 of the PDP in accordance with the exemplary embodiment of the present invention, first dielectric layer 81 in contact with metal bus electrodes 4*b* and 5*b* made of a silver (Ag) material inhibits the yellowing phenomenon and foaming, and second dielectric layer 82 provided on first dielectric layer 81*a* achieves high light transmittance. This structure can provide a PDP that has extremely minimized yellowing and foaming, and high transmittance in the entire dielectric layer 8.

EXAMPLES

For PDPs in accordance with this exemplary embodiment of the present invention, PDPs suitable for a high definition television screen approx. 42 inch in diagonal are fabricated and their performances are evaluated. Each of the PDPs includes discharge cells having 0.15-mm-high barrier ribs at a regular spacing (cell pitch) of 0.15 mm, display electrodes at a regular spacing of 0.06 mm, and a Ne—Xe mixed gas containing 15 vol % of Xe charged at a pressure of 60 kPa.

First dielectric layers and second dielectric layers shown in Tables 1 and 2 are fabricated. PDPs under the conditions of Table 3 are fabricated by combination of these dielectric layers. Table 3 shows panel Nos. 1 through 19, as examples of a PDP in accordance with the exemplary embodiment of the present invention, and panel Nos. 20 through 23, as comparative examples thereof. Sample Nos. A12, A13, B6, and B7 of the compositions shown in Tables 1 and 2 are also comparative examples in the present invention. "Other components" shown in the columns of Tables 1 and 2 are components other than lead as described above, such as zinc oxide (ZnO), boron oxide ($B_2O_3$), silicon dioxide ($SiO_2$), and aluminum oxide ($Al_2O_3$). The contents of these components are not specifically limited, and are within the range of the contents in the conventional arts.

TABLE 1

| Composition of dielectric glass | Sample No. of first dielectric layer | | | | | | | | | | |
|---|---|---|---|---|---|---|---|---|---|---|---|
| (wt. %) | A1 | A2 | A3 | A4 | A5 | A6 | A7 | A8 | A9 | A12 * | A13 * |
| $Bi_2O_3$ | 25 | 27 | 35 | 31 | 40 | 31 | 23 | 22 | 20 | 15 | 35 |
| CaO | — | 2.5 | 6.0 | 9.0 | 8.1 | 12 | 12 | 0.5 | 3.8 | — | 8.0 |
| SrO | 3.3 | 0.9 | — | — | — | — | — | — | 12 | — | — |
| BaO | — | 1.6 | 7.0 | — | — | — | — | 11 | — | — | 7.0 |
| $MoO_3$ | 4.0 | 0.5 | 2.0 | 0.5 | 0.5 | 3.0 | 0.3 | 0.5 | 0.1 | 2.0 | — |
| $WO_3$ | 3.0 | — | — | — | 1.0 | — | — | — | 7.0 | 5.0 | — |
| $CeO_2$ | — | — | — | — | — | — | — | 1.0 | — | — | — |
| $MnO_2$ | — | — | — | — | — | — | — | 5.0 | 0.7 | — | — |
| Other components | 65 | 68 | 50 | 60 | 50 | 55 | 64 | 60 | 57 | 78 | 50 |

* Sample Nos. 12 and 13 are comparative examples.
** "Other components" contain no lead.

TABLE 2

| Composition of dielectric glass | Sample No. of second dielectric layer | | | | | | |
|---|---|---|---|---|---|---|---|
| (wt. %) | B1 | B2 | B3 | B4 | B5 | B6 * | B7 * |
| $Bi_2O_3$ | 11 | 12 | 19 | 19 | 20 | 31 | 10 |
| CaO | 17 | 5.4 | — | 1.6 | 2.0 | 12 | — |
| SrO | — | — | — | — | 1.6 | — | — |
| BaO | 11 | 10 | 21 | 16 | 6.0 | — | 14 |
| $MoO_3$ | 2.0 | — | — | — | — | 3.0 | — |
| $WO_3$ | — | 7.0 | — | 0.7 | — | — | — |
| $CeO_2$ | 0.1 | 1.0 | 1.0 | 3.0 | 0.2 | — | — |
| Other components | 60 | 65 | 59 | 60 | 70 | 55 | 77 |

* Sample Nos. N6 and N7 are comparative examples.
** "Other components" contain no lead.

TABLE 3

| Panel No. | Sample No. of second dielectric layer/ Sample No. of first dielectric layer | Thickness of second dielectric layer/Thickness of first dielectric layer (μm) | Transmittance of dielectric layer (%) | b* value | PDPs with dielectric breakdown after accelerated life test (pcs) |
|---|---|---|---|---|---|
| 1 | No. B1/No. A1 | 20/15 | 90 | 1.8 | 0 |
| 2 | No. B2/No. A2 | 26/13 | 89 | 1.9 | 0 |
| 3 | No. B3/No. A3 | 30/10 | 87 | 1.9 | 0 |
| 4 | No. B4/No. A4 | 26/14 | 88 | 2 | 0 |
| 5 | No. B5/No. A5 | 35/5 | 89 | 2.8 | 0 |
| 6 | No. B1/No. A6 | 23/15 | 86 | 2 | 0 |
| 7 | No. B2/No. A7 | 25/10 | 88 | 2.1 | 0 |

TABLE 3-continued

| Panel No. | Sample No. of second dielectric layer/ Sample No. of first dielectric layer | Thickness of second dielectric layer/Thickness of first dielectric layer (μm) | Transmittance of dielectric layer (%) | b* value | PDPs with dielectric breakdown after accelerated life test (pcs) |
|---|---|---|---|---|---|
| 8 | No. B3/No. A8 | 25/10 | 89 | 1.7 | 0 |
| 9 | No. B4/No. A9 | 25/10 | 90 | 2 | 0 |
| 10 | No. B2/No. A3 | 28/10 | 88 | 2.1 | 0 |
| 11 | No. B3/No. A4 | 25/10 | 91 | 2 | 0 |
| 12 | No. B4/No. A5 | 25/10 | 87 | 2.4 | 0 |
| 13 | No. B5/No. A6 | 25/10 | 88 | 2.2 | 0 |
| 14 | No. B1/No. A3 | 25/10 | 90 | 2 | 0 |
| 15 | No. B5/No. A4 | 25/12 | 89 | 2.4 | 0 |
| 16 | No. B3/No. A5 | 25/10 | 88 | 2.5 | 0 |
| 17 | No. B3/No. A6 | 25/12 | 87 | 2.1 | 0 |
| 18 | No. B2/No. A1 | 25/10 | 91 | 1.8 | 0 |
| 19 | No. B3/No. A1 | 22/15 | 88 | 2 | 0 |
| 20* | No. B1/No. A12 | 25/10 | 91 | 2.1 | 3 |
| 21* | No. B3/No. A13 | 25/10 | 87 | 13.4 | 2 |
| 22* | No. B11/No. A12 | 25/10 | 85 | 2.6 | 3 |
| 23* | No. B12/No. A3 | 25/10 | 90 | 2 | 3 |

*Panel Nos. 20 through 23 are comparative examples.

In each of the PDPs of panel Nos. 1 through 23, metal bus electrodes 4*b* and 5*b* made of a silver (Ag) material are covered with first dielectric layer 81. As shown in Tables 1 through 3, the first dielectric layer is made by firing dielectric glass containing 20 to 40 wt % of at least bismuth oxide ($Bi_2O_3$), and 0.1 to 7 wt % of at least one selected from molybdenum trioxide ($MoO_3$), tungstic trioxide ($WO_3$), cerium dioxide ($CeO_2$), and manganese dioxide ($MnO_2$), at a temperature ranging from 560 to 590° C., to provide a thickness ranging from 5 to 15 μm. Second dielectric layer 82 is further formed on first dielectric layer 81. The second dielectric layer is made by firing dielectric glass containing 11 to 20 wt % of at least bismuth oxide ($Bi_2O_3$), and 0.1 to 7 wt % of at least one selected from molybdenum trioxide ($MoO_3$), tungstic trioxide ($WO_3$), and cerium dioxide ($CeO_2$), at a temperature ranging from 550 to 570° C., to provide a thickness ranging from 20 to 35 μm.

The PDPs of panel Nos. 20 and 21 show the results of a case where the dielectric glass of Table 1 constituting first dielectric layer 81 contains a small amount of bismuth oxide ($Bi_2O_3$), and a case where the dielectric glass contains no molybdenum trioxide ($MoO_3$), tungstic trioxide ($WO_3$), cerium dioxide ($CeO_2$), or manganese dioxide ($MnO_2$), respectively. The PDPs of panel Nos. 22 and 23 show the results of a case where the dielectric glass constituting second dielectric layer 82 contains a large amount of bismuth oxide ($Bi_2O_3$), and a case where the dielectric glass contains no molybdenum trioxide ($MoO_3$), tungstic trioxide ($WO_3$), or cerium dioxide ($CeO_2$), respectively.

These PDPs of panel Nos. 1 through 23 are fabricated and evaluated for the following items. Table 3 shows the evaluation results. First, the transmittance of front panel 2 is measured using a spectrometer. Each of the measurement results shows an actual transmittance of dielectric layer 8 after deduction of the transmittance of front glass substrate 3 and the influence of the electrodes.

The degree of yellowing caused by silver (Ag) is measured with a calorimeter (CR-300 made by Minolta Co., Ltd.) to provide a b*value that indicates the degree of yellowing. As a threshold of the b*value at which yellowing affects the display performance of the PDP, b*=3. When the value is larger, yellowing is more conspicuous, the color temperature is lower, and the PDP is less preferable.

Further, 20 pieces of PDPs are fabricated for each of panel Nos. 1 through 23, and accelerated life tests are conducted on these PDPs. The accelerated life tests are conducted by discharging the PDPs at a discharge sustain voltage of 200V and a frequency of 50 kHz for 4 hours continuously. Thereafter, the number of PDPs of which dielectric layer has broken (dielectric voltage defect) is determined. Because the dielectric voltage defect is caused by such failures as bubbles generated in dielectric layer 8, it is considered that many bubbles have foamed in the panels having dielectric breakdown produced therein.

Results of Table 3 show, for the PDPs of panel Nos. 1 through 19 corresponding to those of this exemplary embodiment of the present invention, yellowing or foaming caused by silver (Ag) is inhibited, to provide high visible-light transmittances of the dielectric layer ranging from 86 to 91% and b*values concerning yellowing as low as 1.7 to 2.8, and no dielectric breakdown has occurred after the accelerated life tests.

In contrast, for the PDP of panel No. 20 in which the content of bismuth oxide ($Bi_2O_3$) in the dielectric glass of the first dielectric layer is as small as 15 wt %, the b*value indicating the degree of yellowing is as small as 2.1. However, low liquidity of the dielectric glass deteriorates adherence thereof to the display electrodes and front glass substrate, thus generating bubbles particularly in the interfaces thereof. This foaming increases dielectric breakdown after the accelerated life tests. For the PDP of panel No. 21 in which the dielectric glass of the first dielectric layer contains no molybdenum trioxide ($MoO_3$), tungstic trioxide ($WO_3$), cerium dioxide ($CeO_2$), or manganese dioxide ($MnO_2$), the degree of yellowing is high, and thus increases foaming and dielectric breakdown.

For the PDP of panel No. 22 in which the dielectric glass of the second dielectric layer contains a large amount of bismuth oxide ($Bi_2O_3$), the visible-light transmittance is decreased and foaming in the dielectric layer is increased. On the other hand, for the PDP of panel No. 23 in which the dielectric glass of the second dielectric layer contains a smaller amount of bismuth oxide ($Bi_2O_3$), and no molybdenum trioxide ($MoO_3$), tungstic trioxide ($WO_3$), or cerium dioxide ($CeO_2$), the visible-light transmittance is excellent, but poor glass liquidity increases foaming and thus conspicuous dielectric breakdown.

For the dielectric material, the content of each component described above has a measurement error in the range of approx. ±0.5 wt %. For the dielectric layer after firing, the content has a measurement error in the range of approx. ±2 wt %. The contents of the components in the range of the values including these errors can provide the similar advantages of the present invention.

As described above, a PDP in accordance with the exemplary embodiment of the present invention can provide an eco-friendly PDP that includes a lead-free dielectric layer having high visible-light transmittance and dielectric strength.

INDUSTRIAL APPLICABILITY

As described above, the present invention provides an eco-friendly PDP with excellent display quality that includes a dielectric layer having minimized yellowing and deterioration of dielectric strength thereof. Thus, the PDP is useful for a large-screen display device and the like.

The invention claimed is:

1. A plasma display panel (PDP) comprising:

a front panel including display electrodes, a dielectric layer, and a protective layer that are formed on a glass substrate; and a rear panel including electrodes, barrier ribs, and phosphor layers that are formed on a substrate, wherein the front panel and the rear panel are faced with each other, and peripheries thereof are sealed to form a discharge space therebetween, wherein each of the display electrodes contains at least silver, and the dielectric layer is substantially lead-free and contains bismuth oxide, tungstic trioxide and at least one of $Ag_2WO_4$, $Ag_2W_2O_7$, and $Ag_2W_4O_{13}$.

2. The PDP of claim 1, wherein the dielectric layer contains tungstic trioxide in a range from 0.1 wt % to 7 wt % (inclusive).

3. The PDP of claim 2, wherein the dielectric layer contains at least one of zinc oxide, boron oxide, silicon dioxide, aluminum oxide, calcium oxide, strontium oxide, barium oxide, cerium dioxide, and manganese dioxide.

4. The PDP of claim 2, wherein the dielectric layer includes a first dielectric layer covering the display electrodes and a second dielectric layer covering the first dielectric layer, wherein the first and the second dielectric layers contain bismuth oxide, and the second dielectric layer contains less bismuth oxide in wt % than the first dielectric layer.

5. The PDP of claim 1, wherein the dielectric layer contains at least one of zinc oxide, boron oxide, silicon dioxide, aluminum oxide, calcium oxide, strontium oxide, barium oxide, cerium dioxide, and manganese dioxide.

6. The PDP of claim 5, wherein the dielectric layer includes a first dielectric layer covering the display electrodes and a second dielectric layer covering the first dielectric layer, wherein the first and the second dielectric layers contain bismuth oxide, and the second dielectric layer contains less bismuth oxide in wt % than the first dielectric layer.

7. The PDP of claim 1, wherein the dielectric layer includes a first dielectric layer covering the display electrodes and a second dielectric layer covering the first dielectric layer, wherein the first and the second dielectric layers contain bismuth oxide, and the second dielectric layer contains less bismuth oxide in wt % than the first dielectric layer.

8. The PDP of claim 7, wherein the first dielectric layer contains bismuth oxide in a range from 20 wt % to 40 wt % (inclusive).

9. The PDP of claim 8, wherein the first dielectric layer is thinner than the second dielectric layer.

10. The PDP of claim 7, wherein the second dielectric layer contains bismuth oxide in a range from 11 wt % to 20 wt % (inclusive).

11. The PDP of claim 10, wherein the first dielectric layer is thinner than the second dielectric layer.

12. The PDP of claim 7, wherein the first dielectric layer is thinner than the second dielectric layer.

* * * * *